US006385948B1

(12) United States Patent
Schneider et al.

(10) Patent No.: US 6,385,948 B1
(45) Date of Patent: May 14, 2002

(54) METHOD OF PACKAGING PLASTIC BAGS, PARTICULARLY BAGS FOR AUTOMATED MACHINES, IN TRANSPORT CONTAINERS

(75) Inventors: Jakob Schneider, Niederkassel; Armin Meyer, Köln, both of (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/527,639

(22) Filed: Mar. 17, 2000

Related U.S. Application Data

(60) Provisional application No. 60/125,790, filed on Mar. 23, 1999.

(30) Foreign Application Priority Data

Mar. 18, 1999 (DE) ..... 199 12 274

(51) Int. Cl.[7] ..... B65B 35/50
(52) U.S. Cl. ..... 53/447; 53/540
(58) Field of Search ..... 53/447, 473, 540, 53/541, 570, 571; 206/554, 499

(56) References Cited

U.S. PATENT DOCUMENTS

| | | | | | |
|---|---|---|---|---|---|
| 3,738,482 | A | * | 6/1973 | Cwikla | 206/571 |
| 3,777,930 | A | * | 12/1973 | Ericson et al. | 206/571 |
| 4,541,226 | A | * | 9/1985 | Nausedas | 53/571 |
| 5,465,845 | A | * | 11/1995 | Norby et al. | 206/554 |

FOREIGN PATENT DOCUMENTS

| | | |
|---|---|---|
| DE | 38 34 115 C1 | 3/1990 |
| DE | 198 39 144 | 4/2000 |

* cited by examiner

*Primary Examiner*—Scott A. Smith
*Assistant Examiner*—Nathaniel Chukwurah
(74) *Attorney, Agent, or Firm*—Herbert Dubno

(57) ABSTRACT

A method of packaging plastic bags, particularly bags for automated machines, in stacks held together by wire brackets in a transport container such as a cardboard box. For the purpose of simple and speedy handling, the bag stacks are deposited in the transport container with outwardly pointing wire bracket legs, so that the bag packages can be deposited in the cardboard enclosure and removed from the same without problems, preferably automatically.

6 Claims, 2 Drawing Sheets

METHOD OF PACKAGING PLASTIC BAGS, PARTICULARLY BAGS FOR AUTOMATED MACHINES, IN TRANSPORT CONTAINERS

CROSS REFERENCE TO RELATED APPLICATION

This application replaces provisional application 60/125,790 filed Mar. 23, 1999.

FIELD OF THE INVENTION

Our present invention relates to a method of packaging plastic bags held in stacks by means of wire brackets, particularly bags for automated machines, into a transport container or box, especially a cardboard box, and for removal of the bag package from the transport box.

BACKGROUND OF THE INVENTION

In a continuous production of plastic bags, a multiplicity of bags are collected in a predetermined number in a collection device to form so-called bag stacks or bag packages. As a feeding device for instance a horizontally moving pin stacking conveyor can be used. This conveyor receives the separated bags on stacking pins. The bag stacks can be secured by wire brackets. For this purpose either the bag stack is lifted off the stacking pins of the pin stacking conveyor and impaled on the legs of the wire brackets with the now loosely superimposed bags, or the legs of the wire brackets are inserted in the hollow-groove recesses of the stacking pins of the pin stacking conveyor, and the bags stacks are removed by lifting the wire brackets with the bag stacks thereon. Subsequently the bag stack has to be secured by means of safety plates or rubber plugs attached to the legs of the bracket. As a rule this process is performed manually by an operator. Attempts have been made to perform automatically the bracket feeding and the bag pickup by the wire brackets. A transfer device of this type is known for instance from German patent document DE 38 34 115 C1.

German patent document 198 39 144 describes a robot-controlled multifunctional hand, which can be moved between a receiving position wherein it picks up a respective bag stack from the pin stacking conveyor and a discharge position, wherein an interlocked bag stack is deposited in a cardboard box or the like in a boxing station, thereby automatically introducing the bag stack into the cardboard box and simplifying and accelerating the packaging.

Independently of whether the introduction of the bag stack into the box is done manually or by means of a robot, the transport container corresponded basically to the size (length and width) of the bag stack. The bags introduced in layers into the cardboard box rest more or less with their lateral edges on the side walls of the cardboard enclosure. The wire brackets holding the bags together are turned over inwardly. The result of this inward flipping of the legs of the wire brackets are unilateral buildups or bilateral buildups when the bags are layered in a staggered mirror-image manner, with a depression in the middle of the stack. Since the individual bag stacks are sometimes also covered on both sides by paper strips or intermediate paper layers, and in addition the above mentioned rubber plugs are attached to the wire brackets, relatively high demands are made on the operator. This particularly then, when due to relatively high production speeds, the continuously repetitive motions have to be performed in short time spans.

OBJECTS OF THE INVENTION

It is an object of the invention to provide an improved method of packaging bag stacks whereby the handling of bag stacks, particularly the introduction, the removal, as well as optionally the supply and positioning of the bag stacks to an automated packing machine can be performed automatically with particularly simple means.

Another object is to provide an improved method of packaging stacks of plastic bags whereby drawbacks of earlier packaging systems are obviated.

It is also an object to provide cardboard which allows for a simple manipulation of the bag stacks introduced in the transport container.

SUMMARY OF THE INVENTION

These objects are achieved, in accordance with the invention, in that the bag stacks are introduced into the transport container with outwardly directed wire bracket legs and are removed for use from the transport container (usually a cardboard box) in a substantially unchanged position. The introduction of the bag stacks into the cardboard enclosure is controlled according to the invention so that the bag packages are laid into the transport container in layers arranged in a mirror-image manner. This permits not only an automated introduction, but also an automated removal of the bag packages, for instance by means of a handling device controlled by means of an optic device or by a robot system which recognizes the position of the wire brackets and grips them for seizing the bag pages, and for instance feeds them to a filling station, such as an automated packaging machine, and positions them in that machine.

Because of the introduction of the bag packages into the box with outwardly pointing wire bracket legs according to the invention, it is basically possible to eliminate the rubber plugs on the wire brackets, which otherwise would be required for securing the individual bags.

For the special kind of bag introduction merely a transport container (especially a cardboard enclosure or box) is required, which on the side of the wire brackets is longer than the bag packages by a distance which allows that the wire bracket legs passed through the suspension holes of the plastic bags to point essentially horizontally outwardly with respect to the side wall of the transport container.

With the means according to the invention an effective automation process can be used in the bag package removal from a transport container (cardboard box), with the positioning of the bag stacks on an automated packaging machine.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
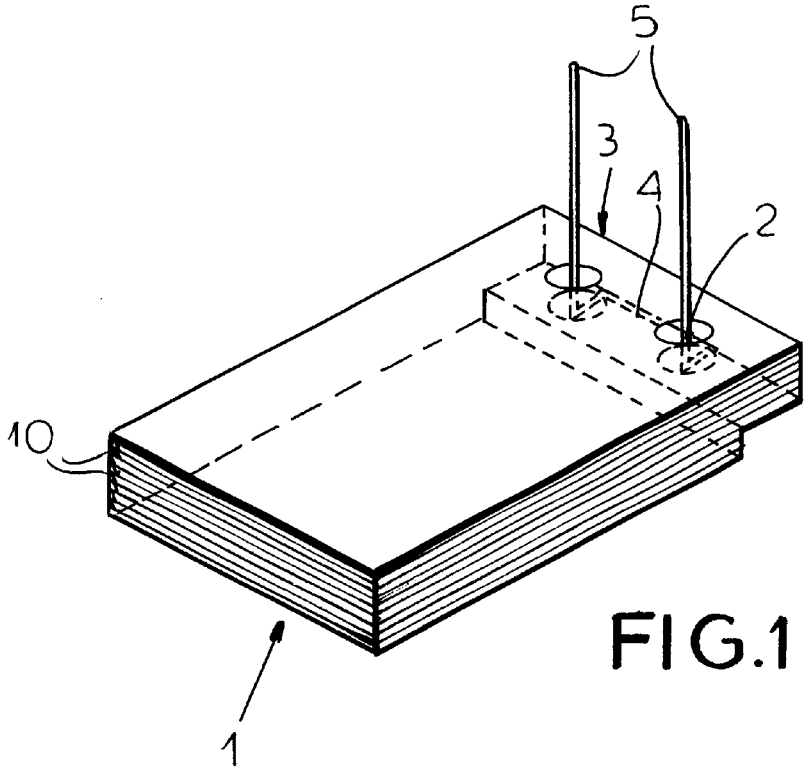
FIG. 1 is a perspective view, in highly diagrammatic form, of a bag stack consisting of several plastic bags with a wire bracket.
Figure 3:
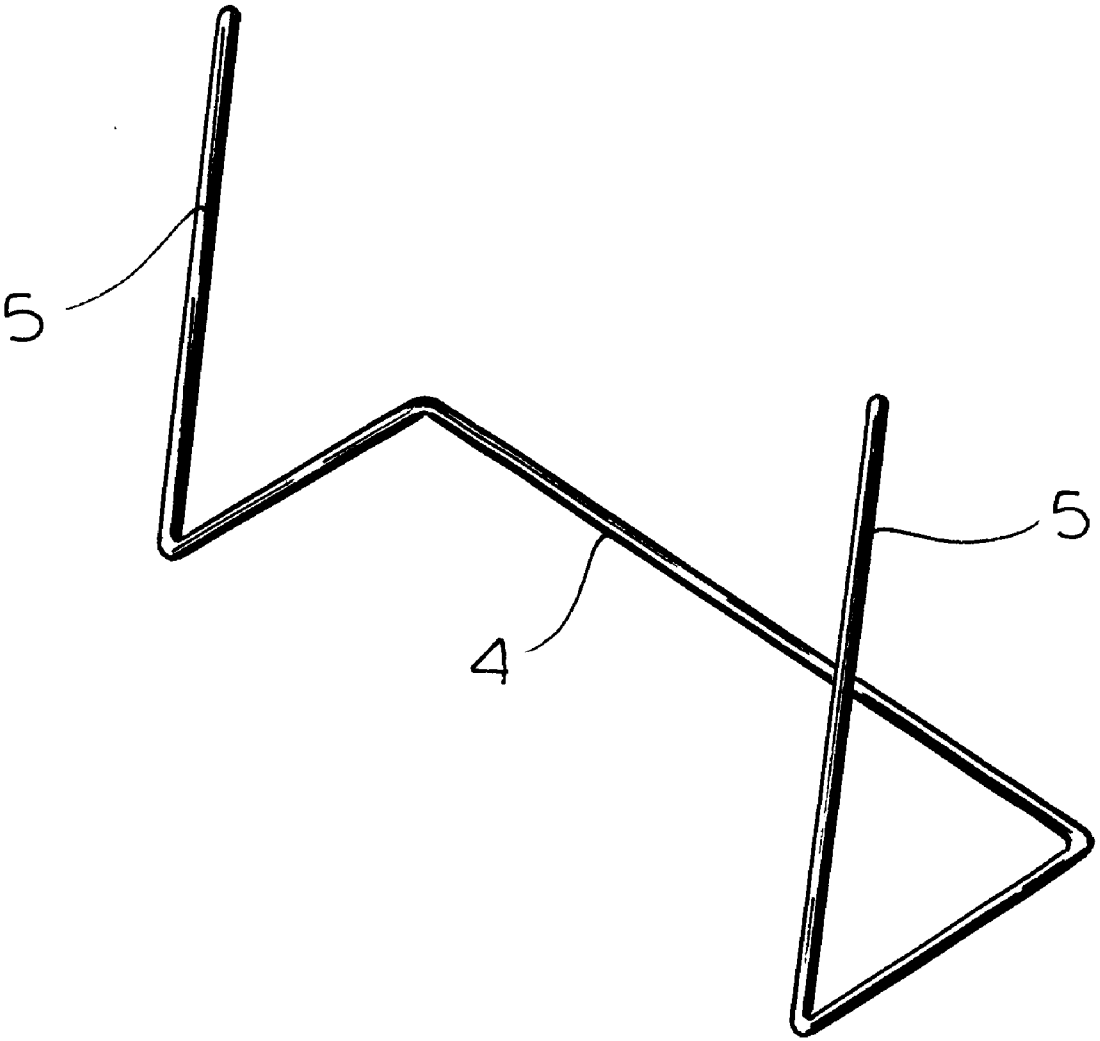
FIG. 3 is a perspective view of the wire bracket.

In the continuous production of bags, individual plastic bags 10 are collected in a predetermined number, in a here not represented collection device, to form bag stacks 1 (FIG. 1). The individual bags are provided in the known manner with suspension holes 2, by means of which during their collection the plastic bags can be collected on stacking pins of a pin stacking conveyor also not represented in the drawing. The bag stacks are secured by means of a wire bracket 3, which consists of a crossweb 4 and two legs 5 (FIG. 3) which are substantially parallel to each other. There are various possibilities for the insertion of the wire brackets. Either the bag stacks are lifted off the stacking pins of the pin stacking conveyor and the now loosely superimposed bags are impaled on the legs of the wire bracket 3 or the legs of the wire bracket 3 are inserted in hollow-groove recesses of the stacking pins of the pin stacking conveyor and the bag stacks are removed with the brackets.

Figure 2:
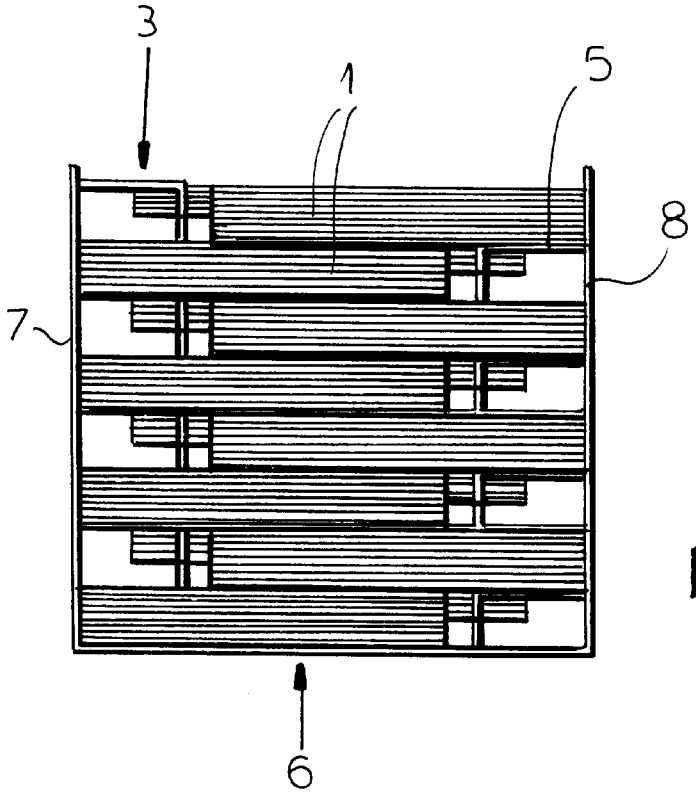
FIG. 2 is a diagram of a transport container in the form of a cardboard enclosure (box) with bag packages provided with wire brackets layered therein.

Several bag stacks are deposited in a cardboard enclosure 6 for transport to a filling operation or machine, as schematically represented in FIG. 2. There the individual bag stacks are deposited in layers in a certain manner, namely so that they are preferably arranged in a staggered and mirror-image fashion, and particularly so that the wire brackets 3 point outwards with their longer legs 5 with respect to the side walls 7, 8 of the cardboard enclosure 6.

The introduction of the bag stacks with the wire brackets can be done either manual, or more suitably by a multifunctional hand of a robot controlled handling system not shown in the drawing. Such a system can also be used on site, within the range of an automated packaging machine. Advantageously this system is equipped with a detection device, for instance an optical device, by means of which the position of the wire brackets 3 or of their legs 5 can be recognized, and corresponding to the position detected by the automatically operating system, the use of the multifunctional hand of the robot-controlled system is initiated and the bag package is fed to the automated packaging machine and there correspondingly positioned.

As can be seen in FIG. 2, based on the special position of the legs of the wire brackets 3, it is possible to eliminate the otherwise required rubber stoppers, and optionally also the otherwise required intermediate cardboard layers and the like.

Further it can be seen from FIG. 2 that the cardboard enclosure 6 has to be lengthened on the side of the wire bracket only by a distance which ensures sufficient space for the horizontally positioned wire brackets, so that they can point outwards with respect to the side walls 7 and 6.

We claim:

1. A method of packaging and unpackaging plastic bags comprising the steps of:

(a) stacking a plurality of plastic bags to form a stack with legs of a wire bracket passing through holes in said bags;

(b) placing a plurality of said stacks automatically in a transport container in a form of a cardboard box open at a top and having side walls with said legs of the brackets of said stacks pointing outwardly toward at least one of said side walls;

(c) for use of said bags, automatically removing said stacks from said container while maintaining an orientation of said legs in step (b); and (d) automatically introducing said stacks into a bag-filling machine, positions of legs of said wire brackets in said box being detected at least in part optically and a robot hand for transferring the stacks being controlled by the detection.

2. A method of packaging and unpackaging plastic bags comprising the steps of:

(a) stacking a plurality of plastic bags to form, a stack with legs of a wire bracket passing through holes in said bags;

(b) placing a plurality of said stacks directly one on top of another in a cardboard box open at a top and having side walls with said legs of the brackets of said stacks pointing outwardly toward at least one of said side walls substantially perpendicularly thereto so that said cardboard box receives a multiplicity of said stacks, said stacks being placed in said box in layers with the legs of the wire brackets of alternate stacks oriented in opposite directions; and (c) for use of said bags, removing said stacks from said container while maintaining an orientation of said legs as in step (b).

3. The method defined in claim 2 wherein said stacks are deposited in said box automatically.

4. The method defined in claim 3 wherein said stacks are removed from said box automatically.

5. The method defined in claim 2 wherein said stacks are removed from said box automatically.

6. The method defined in claim 5, further comprising the step of automatically introducing said stacks into a bag-filling machine.

* * * * *